US005111104A

United States Patent [19]

Hunter

[11] Patent Number: 5,111,104

[45] Date of Patent: May 5, 1992

[54] TRIPLE-ENVELOPED METAL-HALIDE ARC DISCHARGE LAMP HAVING LOWER COLOR TEMPERATURE

[75] Inventor: Scott R. Hunter, Rockport, Mass.

[73] Assignee: GTE Products Corporation, Danvers, Mass.

[21] Appl. No.: 762,155

[22] Filed: Sep. 17, 1991

Related U.S. Application Data

[63] Continuation of Ser. No. 448,494, Dec. 11, 1989, abandoned.

[51] Int. Cl.[5] ..... H01J 17/16

[52] U.S. Cl. ..... 313/25; 313/634

[58] Field of Search ..... 313/25, 634

[56] References Cited

U.S. PATENT DOCUMENTS

| | | | |
|---|---|---|---|
| 3,407,327 | 10/1968 | Koury et al. . | |
| 3,619,682 | 11/1971 | Lo et al. . | |
| 3,662,203 | 5/1972 | Kuhl et al. | 313/25 |
| 4,029,983 | 6/1977 | Thornton | 313/25 |
| 4,499,396 | 2/1985 | Fohl et al. . | |
| 4,791,334 | 12/1988 | Keeffe et al. . | |
| 4,935,668 | 6/1990 | Hansler et al. | 313/634 X |
| 4,942,330 | 7/1990 | Karlotski et al. | 313/25 |

FOREIGN PATENT DOCUMENTS 1-36461 2/1989 Japan .

OTHER PUBLICATIONS

"Electric Discharge Lamps," John J. Waymouth, The M.I.T. Press, 1971, Chapter 10.

*Primary Examiner*—Sandra L. O'Shea

*Attorney, Agent, or Firm*—Joseph S. Romanow

[57] ABSTRACT

A commercially feasible triple-enveloped metal-halide arc-discharge lamp having a hermetically sealed light-transmissive enclosure surrounding the arc tube and a hermetically sealed light-transmissive outer envelope. There is a vacuum within the enclosure and outside the arc tube. There is a gaseous fill within the outer envelope and outside the enclosure. Preferably, metal frame parts within the outer envelope are electrically isolated from the electrical circuit of the lamp in order to minimize sodium loss from the arc tube and providing superior luminous maintenance. The vacuum enclosure about the arc tube eliminates convective heat loss and redistributes reflected heat back to the arc tube such that arc tube operation is hotter and more nearly isothermal. As a result, lamp performance characteristics are comparable or improved with respect to double-enveloped prior art counterparts. Color temperature is substantially reduced. The enclosure acts as an effective containment device in the rare event of a burst of the arc tube. The gaseous fill within the outer envelope minimizes the implosion hazard. A triple-enveloped lamp in accordance with the invention is particularly well suited for high-wattage applications.

8 Claims, 1 Drawing Sheet

TRIPLE-ENVELOPED METAL-HALIDE ARC DISCHARGE LAMP HAVING LOWER COLOR TEMPERATURE

This is a continuation of copending application Ser. No. 07/448,494 filed on Dec. 11, 1989, now abandoned.

TECHNICAL FIELD

This invention relates to the field of metal-halide arc discharge lamps and, more particularly, to such lamps having three hermetically sealed light-transmissive envelopes with controlled atmospheres within each envelope.

BACKGROUND ART

A metal-halide lamp converts into radiation the power dissipated by an electric current passing through a gaseous medium at greater than atmospheric pressure. Appropriate selection of the gaseous medium provides favorable spectral distributions of radiated power. As a result, a metal-halide lamp is substantially more efficient than an incandescent lamp.

A typical double-enveloped metal-halide lamp comprises an inner arc discharge tube containing high-pressure gas or vapor including mercury, metal-halide additives, and a rare gas to facilitate starting. The arc tube is enclosed in a hermetically sealed outer envelope or jacket. The outer envelope is filled with nitrogen or another gas or atmosphere which is inert with respect to internal lamp parts. The arc tube is fabricated from quartz or fused silica, and the outer envelope is formed from a hard glass, such as borosilicate glass. The outer envelope provides thermal insulation, protection of arc tube seals from oxidation, and absorption of short wavelength ultraviolet rays emitted from the arc tube. See, for example, U.S. Pat. No. 3,407,327, issued Oct. 22, 1968, to Koury et al.

One design factor associated with a metal-halide lamp is heat loss from the arc tube by means of convective currents within the atmosphere of the outer envelope. Convective heat loss is caused by transporting heat from the arc tube to the outer envelope by means of gaseous convection currents in the atmosphere within the outer envelope. It is generally true that the overall efficiency of a metal-halide lamp is improved with higher operating temperature of the arc tube walls. Higher operating temperature causes greater quantities of the metal-halide additives to be in the vapor state. An excess of additives is usually provided to insure a saturated vapor state within the arc tube. With more vaporized additives, the luminous output and color temperature of the lamp are improved (i.e., lower color temperature) in most cases. Therefore, it is important to keep heat lost via convection at a minimum. In regard to convective heat loss, a vacuum in the outer envelope is desirable since convective flow would be eliminated.

Another design factor associated with a metal-halide lamp is the problem of sodium loss. Most metal-halide lamps contain a sodium compound as one ingredient of the arc tube fill. During the life of the lamp, sodium migrates through the walls of the arc tube thereby adversely affecting lamp performance. One proposed explanation of the process by which sodium loss occurs is as follows. During operation of the lamp, a photoelectric process, caused by the flux of ultraviolet radiation emitted from the arc tube and incident upon the metal frame parts, liberates electrons which migrate to and collect on the arc tube. The electrons on the outside of the arc tube create an electric field which draws sodium ions through the arc tube walls into the atmosphere of the outer envelope. This process depletes the sodium from within the arc tube causing diminished luminous efficacy and maintenance and, ultimately, reduced lamp life. For a more detailed explanation of the sodium loss problem, see *Electric Discharge Lamps*, by John F. Waymouth, The M.I.T. Press, 1971, Chapter 10, and further references cited therein.

From the viewpoint of sodium loss, a gaseous fill at a substantial pressure within the outer envelope is desirable. The presence of gas molecules of the fill impedes the migration of sodium ions from the outer surface of the arc tube to the metal frame parts within the outer envelope. Increasing the fill pressure increases the density of gas molecules and thereby reduces sodium loss.

Yet another design factor associated with a metal-halide lamp is the possibility of striking an electrical arc between the lead-in wires inside the outer envelope. This "arc-over" problem is especially significant when the atmosphere of the outer envelope is at low pressure, e.g., less than 10 torr. For a more detailed explanation of the arc-over problem, including typical Paschen curves showing ignition potential as a function of fill pressure for various gases, see *Light Sources*, by W. Elenbass, Crane, Russak & Co., Inc., New York, 1972. Regarding the possibility of arc over, a gaseous fill within the outer envelope at a substantial pressure is desirable.

In the event the outer envelope of a metal-halide lamp should be fractured for any reason, the implosion forces will be minimized when the pressure within the outer envelope is as close as possible to the external atmospheric pressure. Regarding this safety factor, a gaseous fill within the outer envelope at the same pressure as the external atmosphere is desirable.

There is another safety consideration associated with the design of a metal-halide lamp. There is a small probability that an arc tube may burst during lamp operation. In the rare event of an arc tube burst, it is highly desirable that the outer envelope of the lamp remain intact. To this end, some sort of burst-restraint structure between the arc tube and outer envelope is desirable. Naturally, such burst-restraint structure should have minimal effect on lamp performance. For examples of various burst-restraint structures, or containment devices, see U.S. Pat. No. 4,888,517, issued Dec. 19, 1989, to Karlotski et al.

The foregoing, while not a complete enumeration of design factors, nevertheless points out some of the conflicting objectives facing a metal-halide lamp designer particularly with respect to the design of the atmosphere within the outer envelope. A vacuum within the outer envelope is desirable for heat insulation of the arc tube and the concomitant improvements in color temperature and luminous efficacy while a gaseous fill at a substantial pressure is desirable for minimizing sodium loss and the likelihood of arc over.

In U.S. Pat. No. 3,619,682, issued Nov. 9, 1971, to Lo et al., there is disclosed a high-wattage double-enveloped metal-halide lamp including means for forcibly cooling the outer (second) envelope. This patent suggests a container or third envelope surrounding the lamp. The container cannot be sealed. It necessarily includes an inlet and outlet for circulating a suitable coolant so that the outer envelope may be forcibly cooled. Moreover, the space between the arc tube and second envelope necessarily must be filled with a fluid which has adequate heat-transfer properties. The overall teaching of Lo et al. is to facilitate heat dissipation from the arc tube and not to conserve heat from the arc tube.

In Fohl et al., U.S. Pat. No. 4,499,396, issued Feb. 12, 1985, there is disclosed a double-enveloped metal-halide lamp having a convection-suppressing enclosure surrounding the arc tube. The enclosure may be closed on both ends. There is no teaching that the enclosure may be hermetically sealed with a vacuum on the inside. The patent teaches that the Rayleigh Number in the region laterally surrounding the arc tube within the enclosure must be controlled in order to limit convective heat loss in this region. The need to suppress convective heat loss in the region presupposes an atmosphere other than a vacuum within the enclosure.

In U.S. Pat. No. 4,791,334, issued Dec. 13, 1988, to Keeffe et al., there is disclosed a double-enveloped metal-halide lamp having a heat-redistribution enclosure surrounding the arc tube. The enclosure may be closed on both ends. The atmosphere within the outer envelope is a vacuum. There is no teaching that the enclosure may be hermetically sealed nor that the atmosphere within the enclosure may differ from the atmosphere within the outer envelope.

These prior art examples illustrate that a metal-halide lamp having the advantages of a vacuum within the outer envelope is known and a lamp having the advantages of a gaseous fill within the outer envelope is known, but there appears to be no prior art example of a single lamp having the combined advantages of a vacuum and a gaseous fill within the outer envelope. In the prior art, these differing advantages appear to be mutually exclusive in the sense that either one set of advantages or the other set is attainable but not both sets in the same lamp.

DISCLOSURE OF THE INVENTION

It is, therefore, an object of the invention to obviate the deficiencies of the prior art.

It is another object of the invention to provide a commercially feasible metal-halide arc-discharge lamp which possesses the combined advantages of a prior art lamp having a vacuum within the outer envelope and a prior art lamp having a gaseous fill within the outer envelope.

It is yet another object of the invention to provide a metal-halide arc-discharge lamp with lower correlated color temperature.

It is still another object of the invention to provide a metal-halide arc-discharge lamp with improved luminous maintenance.

It is another object of the invention to provide a metal-halide arc-discharge lamp which is particularly well suited to high-wattage applications, particularly with respect to minimization of explosion and implosion hazards.

These objects are accomplished, in one aspect of the invention, by provision of a triple-enveloped metal-halide arc-discharge lamp. This lamp comprises a first light-transmissive envelope being a metal-halide arc tube. A second light-transmissive envelope hermetically encloses the arc tube. The atmosphere within the second envelope and outside the arc tube is a vacuum. A third light-transmissive envelope, being an outer envelope, hermetically encloses the second envelope. The atmosphere within the third envelope and outside the second envelope is inert with respect to internal lamp parts. There are means for structurally and electrically completing the lamp.

BEST MODE FOR CARRYING OUT THE INVENTION

Figure 1:
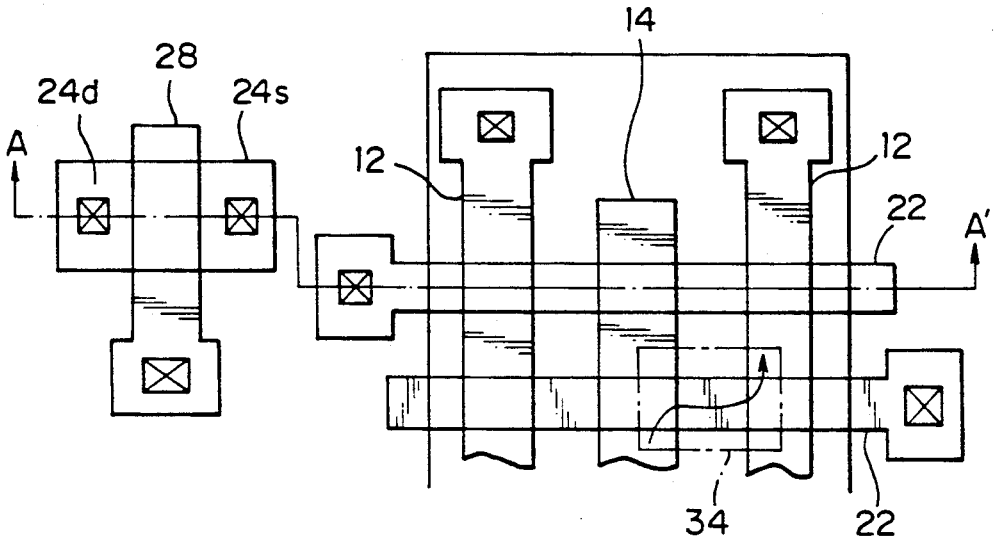
FIG. 1 is an elevational view of an embodiment of the invention showing an arc tube or first envelope within a hermetically sealed enclosure or second envelope within a hermetically sealed outer envelope or third envelope.

For a better understanding of the present invention, together with other and further objects, features, advantages, and capabilities thereof, reference is made to the following disclosure and appended claims taken in conjunction with the above-described drawing.

The terms "efficacy" or "luminous efficacy" used herein are a measure of the total luminous flux emitted by a light source over all wavelengths expressed in lumens divided by the total power input of the light source expressed in watts. The terms "maintenance" or "luminous maintenance" herein denote the ratio of the illuminance on a given area after a period of time to the illuminance on the same area by the same lamp at an initial or benchmark time; the maintenance ratio is a dimensionless number usually expressed as a percentage.

The terms "contain" and "containment" as used herein in connection with a burst of an arc tube mean that the outer envelope of the lamp does not shatter as a result of a burst of the inner arc tube. When containment occurs, all shards and other internal lamp fragments remain within the lamp's outer envelope after a burst of the arc tube.

The term "high-wattage" as employed herein with reference to a metal-halide lamp or lamp component denotes a lamp or component having a rated wattage of one hundred and seventy-five watts or greater.

In a high-wattage metal-halide lamp without a phosphor coating on the inside of the outer envelope, a correlated color temperature of approximately 3,600 degrees Kelvin or less is considered herein to be an improvement, since many with skill in the art desire lower color temperature even in high-wattage lamps. A lamp in accordance with the invention provides a lower correlated color temperature without a phosphor coating, and in this regard it is an improvement over its phosphor counterpart. It is, of course, recognized that lamp designers may desire a correlated color temperature of approximately 3,600 degrees or higher in some applications.

In order to obtain the combined advantages of a lamp having a vacuum within the outer envelope and a lamp having a gaseous fill within the outer envelope, a lamp in accordance with the invention includes a hermetically sealed enclosure between the arc tube and outer envelope such that the atmosphere within the the enclosure and outside the arc tube is a vacuum and the atmosphere within the outer envelope and outside the enclosure is a gaseous fill. Because the arc tube is enclosed in a vacuum, there is no convective heat loss from the arc tube. Consequently, the lamp exhibits substantially improved performance characteristics, particularly a lower color temperature. Since there is a gaseous fill within the outer envelope, sodium migration from the arc tube and the likelihood of arc over are kept to a minimum. When the pressure of the gaseous fill is equal to the atmospheric pressure outside the lamp, the implosion hazard is minimized. A sealed enclosure of appropriate strength and material, acting alone or in combination with other lamp structures, is adequate to contain a burst of the arc tube so that the explosion hazard may also be minimized.

The physical presence of the enclosure about the arc tube reduces the rate of sodium loss. One possible explanation is the following. Although electrons will migrate to the outside wall of the enclosure, this wall has a larger surface area than the outside wall of the arc tube. The electric field created by electron accumulation on the enclosure is weaker than the field caused by an accumulation on the arc tube. Another possible explanation is that sodium ions which have migrated through the arc tube walls will accumulate on the inner surface of the enclosure thereby building up a positive surface charge on the enclosure which deters further diffusion of sodium ions through the arc tube. In either event, the result is that the rate of sodium migration through the arc tube is diminished which translates into improved luminous maintenance of the lamp.

A lamp in accordance with the invention preferably employs a "floating" frame, meaning that the metal frame parts are isolated from the lamp's electrical circuit in order to reduce the emission of photoelectrons from frame parts (which would otherwise occur to a greater extent during portions of the electrical cycle when the frame parts are negative with respect to the enclosure). In combination, the arc tube enclosure, floating frame, and gaseous fill within the outer envelope cooperate to effectively deter sodium loss.

Referring to the drawing in greater particularity, FIG. 1 shows lamp 10 being one embodiment of a triple-enveloped metal-halide arc-discharge lamp in accordance with the invention. As mentioned, lamp 10 has three light-transmissive hermetically sealed envelopes. Metal-halide arc tube 12 is the first envelope. Enclosure 14, which may be a cylindrical tube with press seals at each end as illustrated in the drawing, is the second envelope. Outer envelope (or outer jacket) 16 is the third envelope. Atmosphere 18, being the environment within enclosure 14 and outside arc tube 12, is a vacuum. Gaseous fill 20, a portion of which is shown as an array of dots in the drawing, is the atmosphere within outer envelope 16 and outside enclosure 14.

Arc tube 12 is mounted within outer envelope 16 by means of stiff lead-in wires 22 and 24 which are imbedded in press seals 26 and 28, respectively, of enclosure 14. Arc tube 12 may be a conventional metal-halide arc tube, as shown in the drawing, which is formed from quartz or fused silica and containing a fill including metal-halide additives at least one of which is a sodium compound. In preferred embodiments of lamp 10, arc tube 12 included iodides of sodium and scandium. In alternate embodiments, arc tube 12 may include a heat-reflecting coating, e.g., zirconium oxide, about one or both ends in order to conserve heat within the corresponding end or ends.

Arc tube 12 may include a starting electrode in one end. The electrical lead-in wire for the starting electrode may be sealed in press seal 28 of enclosure 14 in a similar manner as lead-in 24. A thermal switch may be included for shorting out the starting electrode after the lamp has started. These conventional features are illustrated in the drawing.

Cylindrical enclosure 14 is hermetically sealed by means of conventional press seals 26 and 28. Enclosure 14 is mounted within outer envelope 16 by means of metal straps 30 and 32 which tightly grasp and support press seals 26 and 28 on frame members 34 and 36, respectively. Straps 30 and 32 are secured to frames 34 and 36, respectively, such as by welding. Frame members 34 and 36 are securely mounted within outer envelope 16 by means of four tension springs 38 which press against the internal cylindrical walls of outer envelope 16.

Although enclosure 14 is shown as a cylinder with opposed press seals in FIG. 1, there is no functional reason why it may not be formed in a different shape or sealed in another manner (other than practical considerations). Because the vacuum within the enclosure eliminates convective heat loss, there is no convective-flow or Rayleigh Number constraint on the geometry of the enclosure.

In order to have minimal effect on the luminous efficacy of the lamp, enclosure 14 should be highly transmissive of visible light. The luminous efficacy and color temperature of lamp 10 will be enhanced by the higher and more uniform operating temperatures and pressures within arc tube 12. Enclosure 14 should be relatively opaque to infrared radiation in order to minimize heat loss from arc tube 12 through radiation. Preferably, enclosure 14 should reflect and redistribute radiated heat back to arc tube 12 such that temperature gradients along the surface of arc tube 12 are minimized and the operation of arc tube 12 is more nearly isothermal. In alternate embodiments of lamp 10 where there may be a phosphor coating on the inside surface of outer envelope 16, enclosure 14 should be highly transmissive of the phosphor-energizing radiation. Examples of suitable materials from which enclosure 14 may be formed are quartz, fused silica, or alumina. These materials have the ability to withstand the high temperatures about the arc tube.

Stainless steel with a high chromium content is an example of a material suitable for use for the construction of metal straps 30 and 32 because of this material's superior high-temperature properties, relatively low coefficient of thermal expansion, good resistance to oxidation and corrosion, and high tensile strength.

Getter 40 may be mounted on lead-in 24 to maintain the integrity of vacuum 18 within enclosure 14 throughout the life of lamp 10. Helix 42 may be formed in lead-in 22 within enclosure 14 to permit expansion and contraction of lead-ins 22 and 24 during thermal cycling of lamp 10 without significant displacement nor loss of axial alignment of arc tube 12 within enclosure 14.

Lamp 10, as shown in FIG. 1, is single-ended with screw base 44 mounted on outer envelope 16. Base 44 has two electrical poles for coupling with an external source of electrical power through an appropriate ballast. Electrical wires 46 and 48 are connected to the poles of base 44 and are hermetically imbedded in stem 50. Electrical wires 52 and 54 may be electrically connected to lead-ins 22 and 24, respectively, whereby electrical power may be supplied to arc tube 12. Although it may not evident from the drawing, frames 34 and 36 are preferably electrically isolated from the electrical circuit of lamp 10 in order to reduce sodium loss from arc tube 12; in particular, neither frame 34 nor 36 contacts any of electrical wires 46, 48, 52, and 54 in FIG. 1.

Outer envelope 16 may be formed, such as by blow molding, from a suitable hard glass, e.g., borosilicate glass. Gaseous fill 20 may be any suitable gas which does not chemically react with lamp parts and materials within outer envelope 16, particularly with the metal frame and support structures. In alternate embodiments having a phosphor coating on the inside surface of the outer envelope, fill 20 may be adapted to the desired phosphor-maintenance stoichiometry. Getter 56 may be mounted, e.g., by welding, on frame 36 to remove unwanted elements from fill 20.

In preferred embodiments of lamp 10, fill 20 comprised nitrogen gas at a cold pressure, i.e., at room temperature, ranging between approximately one hundred torr to slightly over one atmosphere. From a safety viewpoint, the optimum cold pressure for fill 20 is that cold pressure corresponding to an steady state operating pressure which matches the external atmospheric pressure so that the implosion hazard is minimum during lamp operation. For a 400-watt Sylvania Metalarc lamp, this optimum cold pressure for fill 20 is approximately four hundred torr.

Lamp 10 may be sized for any practical lamp wattage. In high-wattage lamps having larger outer envelopes, i.e., 175 watts or higher, a vacuum within the outer envelope poses a more formidable implosion hazard. Consequently, lamp 10 is particularly well suited to high-wattage lamps. Nevertheless, a low-wattage lamp is within the scope of the invention.

WORKING EXAMPLES

Laboratory examples of the invention were fabricated, tested, and compared with two double-enveloped counterparts from the prior art. In the following tables, Lamp A is a 400-watt triple-enveloped lamp in accordance with the invention. It is a M400/U Sylvania Metalarc lamp modified to include a sealed enclosure about the arc tube with a vacuum within the enclosure.

Lamp B is an unmodified 400-watt double-enveloped lamp with a gaseous fill within the outer envelope. There is no enclosure surrounding the arc tube within the outer envelope. This lamp is a standard M400/U Sylvania Metalarc lamp. Comparison of performance data for Lamps A and B will provide evidence of the advantages provided by the invention over a prior art lamp without an enclosure about the arc tube within the outer envelope.

Lamp C is identical to Lamp B except that it includes a cylindrical enclosure, open at both ends, surrounding the arc tube. Lamp C is a standard MP400/BU open fixture Super Metalarc Lamp. Comparison of performance data for Lamps A and C will provide evidence of the advantages provided by the invention over a prior art lamp with a gas-filled enclosure about the arc tube within the outer envelope.

TABLE I

| | Lumen Output | | |
|---|---|---|---|
| No. | Lamp A | Lamp B | Lamp C |
| 1 | 38,712 | 34,747 | 36,041 |
| 2 | 36,022 | 32,759 | 33,503 |
| Avg. | 37,367 | 33,753 | 34,772 |

TABLE I shows the lumen output in lumens of two laboratory examples of each of the aforementioned lamps measured after one hundred hours of operation, cycled ten hours of operation and two hours off. The third entry in the table is the average value of the observations of the two examples of the same lamp type.

Comparison of the average lumen outputs for Lamps A and B shows that there is an approximate eleven percent increase in Lamp A as a result of the inclusion of a vacuum enclosure despite the additional envelope. Comparison of the average lumen outputs for Lamps A and C shows that Lamp A exhibits an approximate seven percent increase over Lamp C. These data support the conclusion that the arc tube operates more efficiently within a vacuum enclosure than it does within a gas-filled enclosure. This result is believed to be attributable to the fact that the arc tube operates at a higher and more uniform temperature within a vacuum enclosure.

TABLE II

| | Correlated Color Temperature | | |
|---|---|---|---|
| No. | Lamp A | Lamp B | Lamp C |
| 1 | 3,549 | 3,814 | 4,131 |
| 2 | 2,963 | 4,272 | 3,774 |
| Avg. | 3,256 | 4,044 | 3,953 |

TABLE II shows the correlated color temperatures in degrees Kelvin of two laboratory examples of each of the aforementioned lamps measured after one hundred hours of operation, cycled ten hours of operation and two hours off. The third entry in the table is the average value of the observations of the two examples of the same lamp type.

Comparison of the average correlated color temperature values for Lamps A and B shows that there is an approximate nineteen percent reduction in correlated color temperature as a result of the inclusion of a vacuum enclosure within the outer envelope. Comparison of the average correlated color temperature values for Lamps A and C shows that Lamp A exhibits an approximate eighteen percent reduction in correlated color temperature over Lamp C. These data demonstrate an impressive reduction in correlated color temperature attributable to the vacuum enclosure.

TABLE III

| | Color Rendering Index | | |
|---|---|---|---|
| No. | Lamp A | Lamp B | Lamp C |
| 1 | 66 | 56 | 60 |
| 2 | 59 | 56 | 57 |
| Avg. | 62.5 | 56 | 58.5 |

TABLE III shows the color rendering indices (CRIs) of two laboratory examples of each of the aforementioned lamps measured after one hundred hours of operation, cycled ten hours of operation and two hours off. The third entry in the table is the average value of the observations of the two examples of the same lamp type.

Comparison of the average color rendering index values for Lamps A and B shows that there is a 6.5 point increase in the CRI as a result of the inclusion of a vacuum enclosure within the outer envelope. Comparison of the average CRI values for Lamps A and C shows that Lamp A exhibits a four point CRI increase over Lamp C.

Review of all of the data indicates that the gas-filled enclosure of Lamp C provides containment security and a minor improvement in lamp performance. The vacuum enclosure of Lamp A, however, provides containment security and a substantial improvement in lamp performance, particularly in the reduction of color temperature.

Although luminous maintenance data is not yet available, it is anticipated that a lamp in accordance with the invention will exhibit superior maintenance. As mentioned above, a triple-envelope lamp design with a vacuum enclosure, floating frame, and gaseous fill within the outer envelope is expected to deter sodium migration from the arc tube thereby eliminating or substantially reducing a major cause of poor luminous maintenance.

While there have been shown and described what are at present considered to be the preferred embodiments of the invention, it will be apparent to those skilled in the art that various changes and modifications can be made without departing from the scope of the invention as defined by the appended claims.

We claim:

1. A metal-halide arc-discharge lamp comprising:

means for providing a correlated color temperature of approximately 3,600 degrees Kelvin or less and a luminous efficacy of approximately 90 lumens per watt or higher, said means including in combination:

(a) a first light-transmissive envelope being a metal-halide arc tube;

(b) a second light-transmissive envelope hermetically enclosing said arc tube, the atmosphere within said second envelope and outside said arc tube being a vacuum;

(c) a third light-transmissive envelope being an outer envelope, said third envelope hermetically enclosing said second envelope, the atmosphere within said third envelope and outside said second envelope being inert with respect to internal lamp parts, said third envelope being light-transmissive through substantially all of the surface of said third envelope; and (d) means for structurally and electrically completing said lamp.

2. An arc discharge lamp as described in claim 1 wherein said arc tube is elongated along a central axis and said second envelope is elongated along said central axis with two opposed ends, there being a press seal in each of said ends.

3. An arc discharge lamp as described in claim 1 wherein said inert atmosphere is nitrogen gas.

4. An arc discharge lamp as described in claim 3 wherein said nitrogen gas has a cold pressure of approximately four hundred torr.

5. An arc discharge lamp as described in claim 1 wherein said lamp includes two electrical lead-in wires and metal frame parts within said third envelope and said metal frame parts are electrically isolated from said lead-in wires, whereby sodium migration from within said arc tube is substantially suppressed.

6. An arc discharge lamp as described in claim 1 wherein the operating wattage of said lamp is equal to or greater than one hundred and seventy-five watts.

7. An arc discharge lamp as described in claim 1 wherein said lamp is single-ended, there being a lamp base mounted on said third envelope.

8. An arc discharge lamp as described in claim 1 wherein said lamp has a phosphor coating on the inside surface of said third envelope.

* * * * *

UNITED STATES PATENT AND TRADEMARK OFFICE

CERTIFICATE OF CORRECTION

PATENT NO. : 5,111,104

DATED : May 5, 1992

INVENTOR(S) : Scott R. Hunter

It is certified that error appears in the above-identified patent and that said Letters Patent is hereby corrected as shown below:

The Title page, showing the illustrative figure, should be deleted to be replaced with the attached title page.

Figure 2:
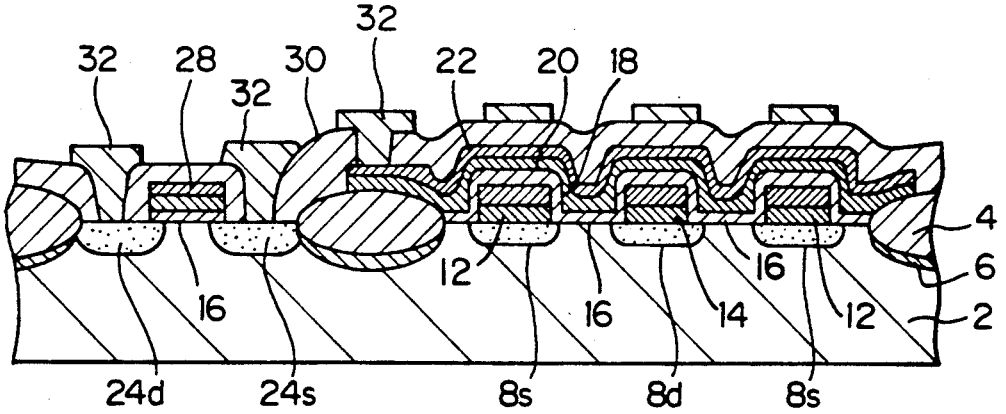
Figure 1:
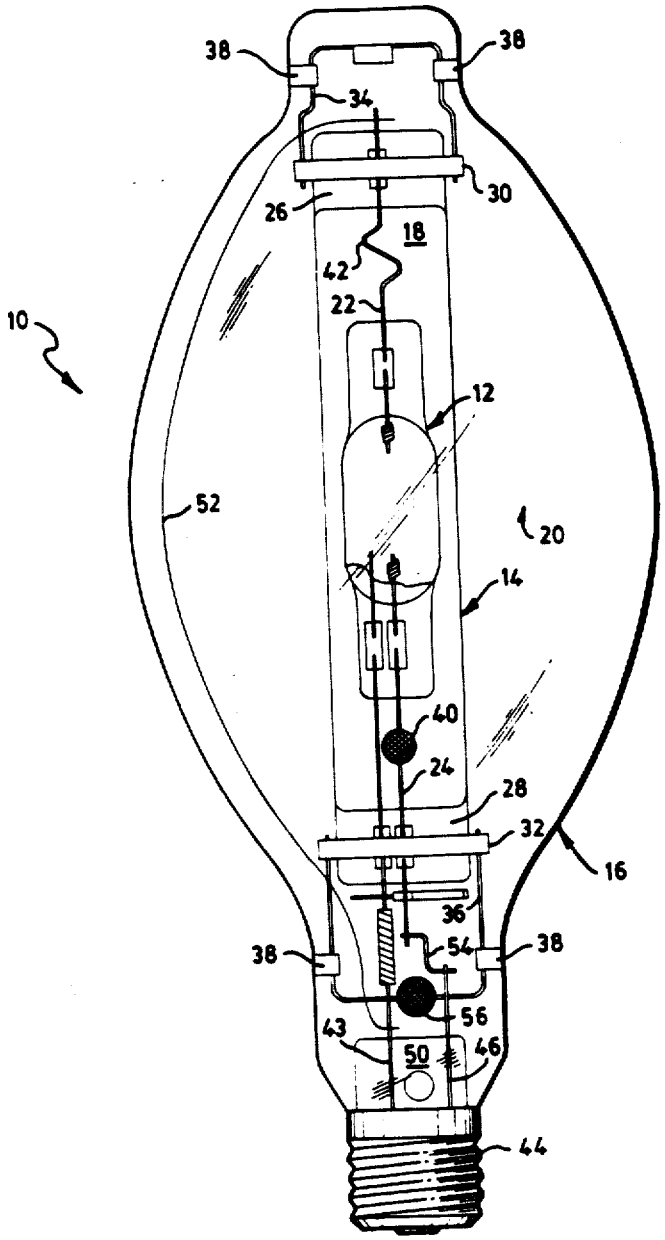

The Drawing sheet consisting of figs. 1 and 2 should be deleted and replaced with the attached Drawing sheet (Fig.1).

Signed and Sealed this

Twelfth Day of January, 1993

*Attest:*

*Attesting Officer*

DOUGLAS B. COMER

*Acting Commissioner of Patents and Trademarks*

United States Patent [19]

Hunter

[11] Patent Number: 5,111,104

[45] Date of Patent: May 5, 1992

[54] TRIPLE-ENVELOPED METAL-HALIDE ARC DISCHARGE LAMP HAVING LOWER COLOR TEMPERATURE

[75] Inventor: Scott R. Hunter, Rockport, Mass.

[73] Assignee: GTE Products Corporation, Danvers, Mass.

[21] Appl. No.: 762,155

[22] Filed: Sep. 17, 1991

Related U.S. Application Data

[63] Continuation of Ser. No. 448,494, Dec. 11, 1989, abandoned.

[51] Int. Cl.[5] ..... H01J 17/16

[52] U.S. Cl. ..... 313/25; 313/634

[58] Field of Search ..... 313/25, 634

[56] References Cited

U.S. PATENT DOCUMENTS

| | | | |
|---|---|---|---|
| 3,407,327 | 10/1968 | Koury et al. . | |
| 3,619,682 | 11/1971 | Lo et al. . | |
| 3,662,203 | 5/1972 | Kuhl et al. | 313/25 |
| 4,029,983 | 6/1977 | Thornton | 313/25 |
| 4,499,396 | 2/1985 | Fohl et al. . | |
| 4,791,334 | 12/1988 | Keeffe et al. . | |
| 4,935,668 | 6/1990 | Hansler et al. | 313/634 X |
| 4,942,330 | 7/1990 | Karlotski et al. | 313/25 |

FOREIGN PATENT DOCUMENTS 1-36461 2/1989 Japan .

OTHER PUBLICATIONS

"Electric Discharge Lamps," John J. Waymouth, The M.I.T. Press, 1971, Chapter 10.

*Primary Examiner*—Sandra L. O'Shea

*Attorney, Agent, or Firm*—Joseph S. Romanow

[57] ABSTRACT

A commercially feasible triple-enveloped metal-halide arc-discharge lamp having a hermetically sealed light-transmissive enclosure surrounding the arc tube and a hermetically sealed light-transmissive outer envelope. There is a vacuum within the enclosure and outside the arc tube. There is a gaseous fill within the outer envelope and outside the enclosure. Preferably, metal frame parts within the outer envelope are electrically isolated from the electrical circuit of the lamp in order to minimize sodium loss from the arc tube and providing superior luminous maintenance. The vacuum enclosure about the arc tube eliminates convective heat loss and redistributes reflected heat back to the arc tube such that arc tube operation is hotter and more nearly isothermal. As a result, lamp performance characteristics are comparable or improved with respect to double-enveloped prior art counterparts. Color temperature is substantially reduced. The enclosure acts as an effective containment device in the rare event of a burst of the arc tube. The gaseous fill within the outer envelope minimizes the implosion hazard. A triple-enveloped lamp in accordance with the invention is particularly well suited for high-wattage applications.

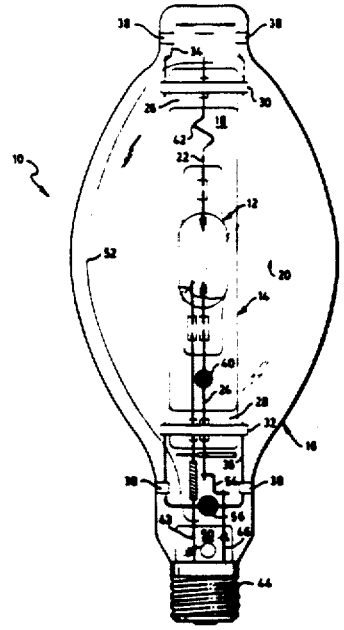

8 Claims, 1 Drawing Sheet